United States Patent [19]

King

[11] Patent Number: 5,012,938

[45] Date of Patent: May 7, 1991

[54] STORAGE RACK CORNER POST

[75] Inventor: John R. King, West Bloomfield, Mich.

[73] Assignee: S&K Enterprises, Inc., Detroit, Mich.

[21] Appl. No.: 481,628

[22] Filed: Feb. 16, 1990

[51] Int. Cl.[5] ..... A47F 5/00

[52] U.S. Cl. ..... 211/191; 211/182

[58] Field of Search ..... 211/191, 190, 189, 182; 403/231, 230, 247, 217, 219

[56] References Cited

U.S. PATENT DOCUMENTS

| | | | |
|---|---|---|---|
| 3,592,345 | 7/1971 | Featherman | 211/191 |
| 3,625,372 | 12/1971 | MacKenzie | 211/191 |
| 3,788,490 | 1/1974 | Featherman | 211/191 |
| 4,074,812 | 2/1978 | Skubic et al. | 211/191 X |
| 4,801,026 | 1/1989 | Andersson | 211/191 X |

FOREIGN PATENT DOCUMENTS

| | | | |
|---|---|---|---|
| 634769 | 7/1963 | Belgium | 211/191 |
| 2067706 | 7/1981 | United Kingdom | 211/191 |

*Primary Examiner*—Robert W. Gibson, Jr.
*Attorney, Agent, or Firm*—Harness, Dickey & Pierce

[57] ABSTRACT

A frame type, heavy duty storage rack corner post is formed of sheet metal which is bent into a rear wall, integral side walls and front wall sections that are spaced apart to form a central slot extending the height of the post. The free edges of the front wall sections are bent outwardly to form a pair of parallel base walls which terminate in oppositely extending flanges, so that the front wall sections, base walls and flanges form oppositely opening, aligned vertically extending channels along the height of the post. The channel base walls are provided with a series of holes, with the holes in one aligned horizontally with the holes in the other. The channels are of a width to snugly receive a nut so that a screw may be inserted through a pair of aligned holes and threadedly engaged with the nut for turning the screw while the nut is held stationary by the channel walls.

12 Claims, 2 Drawing Sheets

STORAGE RACK CORNER POST

BACKGROUND OF INVENTION

This invention relates to an improved corner post used in frame-type, heavy duty, storage or pallet racks and, particularly, posts that may be rapidly assembled with interconnecting braces to form the side walls of such a rack.

Heavy duty storage or pallet racks generally consist of vertical, tubular or hollow, sheet metal posts which are interconnected by horizontal or angled elongated braces and horizontal beams to form a shelf-like frame structure. Pairs of these posts are connected together by both horizontal and angled tubular braces to form the open, side walls of an open frame unit. Two opposite side walls are connected together by horizontal beams to provide shelf-like supports for heavy loads, such as pallets, boxes or the like. Sometimes, shelving is mounted upon the beams for supporting the loads.

An example of a pallet rack is shown in my prior U.S. Pat. No. 4,769,682 issued Aug. 2, 1988 for a "Tubular Rack Beam and Method of Making Same". Other examples of storage or pallet racks are disclosed in U.S. Pat. No. 4,074,812 to Skubic et al for a "Pallet Rack", U.S. Pat. No. 4,815,613 issued Mar. 28, 1989 to Hollander for a "Roll-Through Storage Rack, a Girder and a Retaining Plate Therefor"; U.S. Pat. No. 4,801,026 issued Jan. 31, 1989 to Andersson for a "Device in a Storage Rack"; U.S. Pat. No. 4,778,067 issued Oct. 18, 1988 to Bellerose for a "Knock-Down Support Structure for Shelving Units and Method of Assembly"; U.S. Pat. No. 3,625,372 issued Dec. 7, 1971 to MacKenzie for a "Pallet Rack"; U.S. Pat. No. 4,423,817 issued Jan. 3, 1984 to Monjo-Rufi for a "Shelf Rack" and U.S. Pat. No. 3,592,345 issued July 13, 1971 to Featherman for a "Erectible Metal Shelving".

In the manufacture of such racks, the posts and the interconnecting beams and braces may be inventoried by the manufacturer, as separate parts which are shipped, when required, to the place of use or to distributors who will either assemble the frame unit or, in turn, deliver the parts to the place of use. Then the parts are assembled into the rack. At times, the parts for the frame unit may be assembled by the manufacturer or distributor for reducing the amount of labor needed at the place of final use and assembly. That is, it is conventional to pre-assemble pairs of posts with interconnecting, horizontal and angularly arranged braces to form side walls for the rack. The pre-assembled side walls are then shipped, either directly or through distributors, to the place of use where horizontal beams are assembled to the posts to form the front and rear shelf-like portions of the rack upon which loads are supported.

The assembly of the posts, braces and beams at the site of use requires considerable time and effort and, therefore, is relatively expensive. The partial assembly of the side wall forming posts and braces prior to shipping reduces the amount of labor needed for on-site assembly. However, such pre-assembled side wall units are large and, therefore, are relatively expensive to ship and to store because of the amount of space they require. Thus, it would be desirable to ship the parts in completely knock-down or unassembled condition but to have some means for rapidly assembling them on-site so as to reduce the amount of labor and labor expenses required for field assembly.

The invention herein relates to an improved post construction which permits complete knock-down delivery of the parts to the site of assembly and enables rapid, minimal labor assembly of the parts into the complete rack.

SUMMARY OF INVENTION

The invention herein contemplates an open frame type of heavy duty storage or pallet rack which is formed of vertical corner posts that are interconnected from front to back with horizontal and with angled tubular, elongated braces and from side to side with elongated, heavy duty support beams. The posts are squared C-shape in cross-section with integrally bent sheet metal rear walls, side walls, and forward wall sections which are spaced apart to form a vertically elongated slot in the post. The free edges of the forward wall sections, however, are further bent into forwardly extending base walls which terminate in outwardly bent flanges to provide oppositely opening, narrow, vertically arranged channels on the forward wall of each post. Holes are formed in the base walls, with the holes in one base wall aligned with corresponding holes in the opposite base walls to receive a screw type fastener therebetween.

It is contemplated to arrange the posts in pairs. The forward wall of one post faces toward the forward or front wall of an opposite post and the braces extend between the facing forward walls of each pair of posts to form frame-type side walls for the rack. The space between the base walls of each post is selected to closely and snugly receive end portions of the interconnecting horizontal and angled braces. These braces are provided with holes in their end portions so that screw fasteners may be inserted through the aligned holes in the base walls and through the end portions of the braces for engagement. The screw fasteners are secured with nuts that are positioned within the channels on the post forward walls. The channels are o a width to hold the nuts against turning so that a workman using a simple screw driver may thread the screws within their stationary nuts for rapid assembly. In addition, the spaced apart base walls provide rigid supports for rapid alignment or positioning of the interconnecting braces relative to their posts to facilitate the assembly of the pairs of post forming the rack side walls.

In addition, a sheet metal base plate is provided for supporting the posts upon the support floor surface. The plate has upwardly bent ears or strips that fit into the lower ends of the opposite opening post forward wall channels and, consequently, are rapidly assembled to the posts.

A basic object of this invention is to provide a rapidly assembleable construction by which a pair of posts and a number of interconnecting braces can be quickly assembled by an individual workman with minimal time and effort so that the various parts may be shipped to the site of use and assembled on-site rapidly and economically.

A further object of this invention is to provide a post construction which permits assembling the side walls of a storage or pallet rack on-site, with minimal labor and time requirements, from knock-down parts shipped to the site.

Still a further object of this invention is to provide a storage rack which may be shipped in knockdown or separated part condition and which may be assembled with minimal labor so as to reduce the cost of storing and shipping the rack.

Yet an additional object of this invention is to provide sheet metal inserts that may be used within a conventional C-shaped cross-section rack post for permitting that post to be used as if it were provided with the improved forward wall channel construction of this invention that enables rapid on-site assembly of the post and brace side walls of a frame type rack.

These and other objects and advantages of this invention will become apparent upon reading the following description, of which the attached drawings form a part.

DETAILED DESCRIPTION

Figure 1:
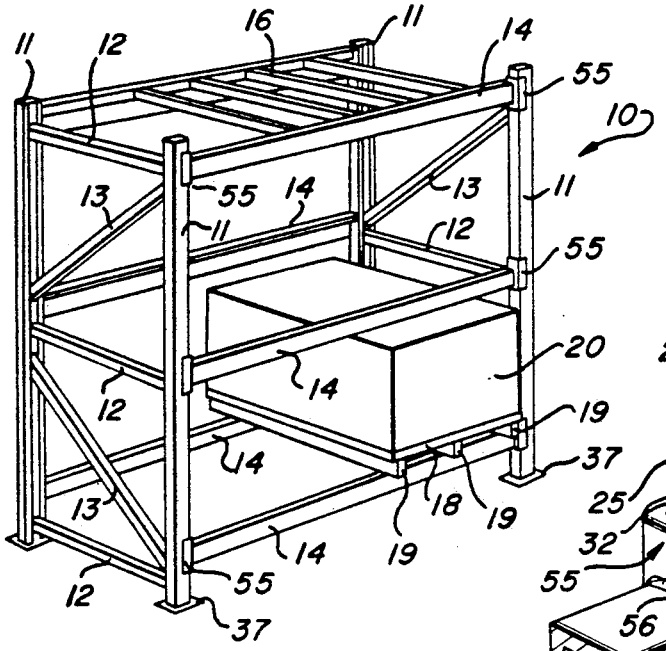
FIG. 1 is a schematic, perspective view of a heavy duty storage or pallet type rack of this invention.

FIG. 1 illustrates a conventional storage or pallet rack 10. The rack is in the form of an open framework made of sheet metal tubes that are roll formed into desired cross-sections. Thus, the rack comprises corner posts 11 which are interconnected by horizontally arranged braces 12 and angled braces 13 to form the sides of the rack. Beams 14 interconnect the corner posts along the front and rear of the rack. The cross-sectional shapes of the braces and beams may vary considerably. Thus, the braces are shown, by way of example, as being formed in a rectangular cross-section. The beams are illustrated as being roll formed into an approximately rectangular shape, but with step-like shoulders 15 formed along one upper edge. These shoulders may receive the opposite ends of slats 16 which span from front to rear of the rack to form a shelf.

The rack may be used either as an open frame with the beams directly supporting loads or with load supporting slats 16 or, alternatively, with shelving in the form of large sheets of plywood o metal extending between the beam shoulders.

For illustration purposes, a pallet 18 is shown positioned upon the lower front and rear beams 14. The pallet, which may be in the form of a standard metal or wood platform, has conventional wood or metal skids 19. A load, such as a container or pile of material 20 is positioned upon the pallet. Racks of the type involved are made to support heavy weights, as for example, large bins or containers, large metal pieces such as engines or metal castings or the like, or other large, heavy articles.

Figure 2:
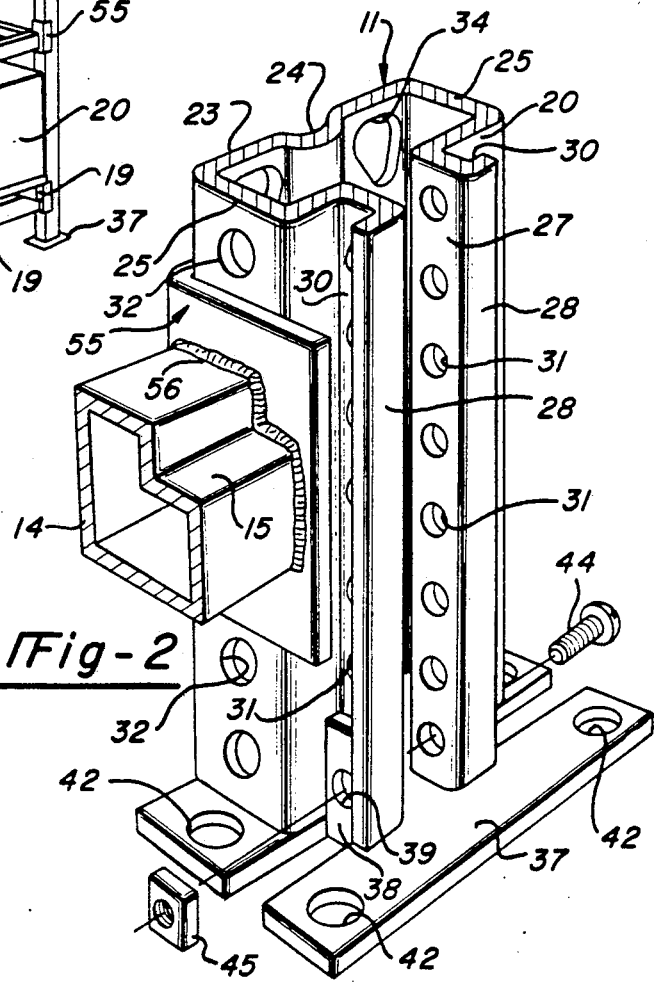
FIG. 2 is an enlarged, perspective, fragmentary view of the lower portion of the supported corner post with a horizontal beam attached thereto.
Figure 3:
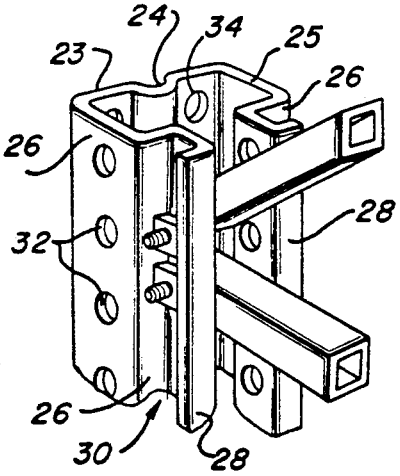
FIG. 3 is a smaller scale view, in perspective, showing the assembly of a horizontal and an angled brace upon a post.
Figure 4:
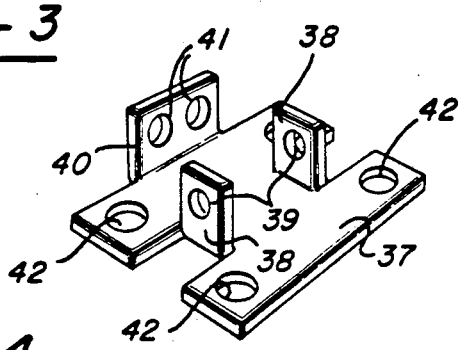
FIG. 4 is a perspective view of the floor support plate.
Figure 6:
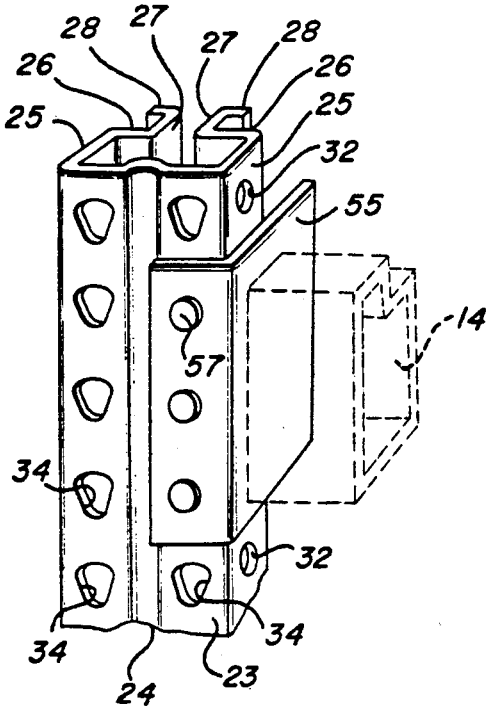
FIG. 6 is a perspective, fragmentary view showing a horizontal beam connecting bracket mounted upon a section of the post, with the beam shown in dotted lines.
Figure 7:
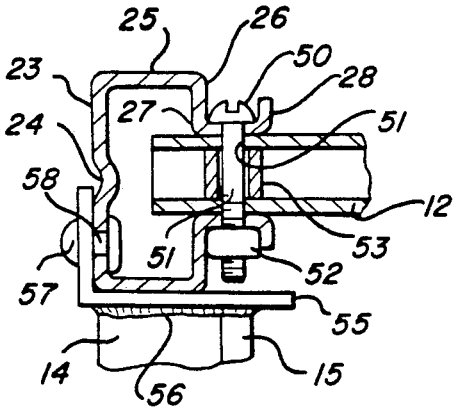
FIG. 7 is a cross-sectional view of the post having a brace end portion fastened therein and with a beam connecting bracket connected to the post

Referring to FIGS. 2, 6 and 7, the corner posts 11 are roll formed from suitable sheet metal into a roughly squared C cross-sectional shape. Thus, each post includes a rear wall 23 having a vertical ridge or bead 24 arranged along its central, vertical axis. The rear wall is bent into integral side walls 25 which, in turn, are bent to form opposing forward or front wall sections 26. The free edges of the front wall sections are bent forwardly, that is, away from the rear wall 23, to form base walls 27 which terminate in outwardly bent flanges 28. The combination of the front wall sections 26, base walls 27 and flanges 28, provide sidewardly and outwardly opening opposite channels 30 on the forward or front wall of the post.

A series of holes 31 are formed in the channel base walls 26 with the holes in one channel being aligned horizontally with corresponding holes in the other channel for receiving fasteners such as bolts or screws.

In addition, holes 32 are formed in the side walls for use in fastening various items to the posts. Also, two vertical rows of holes 34 are formed in the rear walls on opposite sides of the ridge 24. These holes 34 are formed in the shape of inverted tear-drops or bayonet slots.

The posts are rested upon sheet metal base plates 37 which are H-shape in configuration. The plates are slit and tabs or strips 38 are bent upwardly, using the material between the legs defining the H-shape. These strips are provided with holes 39.

Further, an integral, bent-up tongue or flange 40 is formed on the central, edge portion of one of the legs of the H-shape of the plate. That flange also is provided with a hole 42.

Figure 5:
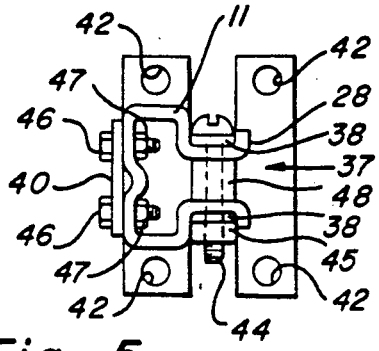
FIG. 5 is a plan view of the post connected to a floor support plate.

As illustrated in FIGS. 2 and 5, a screw 44 is inserted through the aligned screw holes 39, that are formed in the base plate bent-up strips 38, and through the lowermost holes 31 in the post channel base walls 27. This screw threadedly engages a nut 45 which is positioned within one of the channels. The nut is so sized that it will not turn within the channel, but rather will remain immobile when the screw is rotated with a screwdriver. In addition, screws or bolts 46, engaging with nuts 47, extend through the holes 41 in the bent-up tongue 40 in the plate and also through the corresponding lowermost holes 34 in the rear wall of the post. A cylindrically shaped spacer bushing 48 is arranged within the space between the two opposed base walls to stiffen the lower end of the post.

Holes 42 formed in the base plate H-shaped legs are used for fasteners that extend through the plate and into the support floor. For example, suitable bolts (not shown) may be inserted through the holes 42 and embedded within a concrete floor surface upon which the rack is supported.

The horizontal braces 12 and angled braces 13 are inserted between the post base walls 27 and fastened in place by screws. The braces are of a size to snugly fit between the base walls so that they are held against wobbling or transversely moving relative to the posts.

Screws 50, as shown in FIG. 7, extend through aligned holes 51 in the end portions of the braces, and aligned holes 31 in the base walls 27 of the post. Square shaped nuts 52 ar snugly fitted within the channel 30 so that the screw 50 may be turned either manually with the screwdriver or with an automatic screwdriver, while the square nut will remain immobile for rapid threaded engagement of the screw. Preferably, cylindrically shaped spacer-bushings 53 are positioned within the braces. The screws 50 pass through these spacer-bushings.

Figure 8:
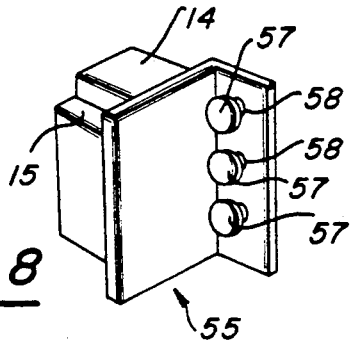
FIG. 8 is a perspective view showing the inside of the beam connecting bracket with the end portion of a beam connected thereto.

The horizontal front and rear beams 14 are connected to the posts by means of angle brackets 55. That is, the beams are fastened, such as by welds 56 to one leg of the bracket (see FIG. 2). Headed rivet-like pins 57 are secured to the other leg of the bracket (see FIGS. 6–8). The heads of the pins are inserted through the widened portions of the inverted tear-drop shaped holes 34 in the post rear wall 23. Then, the pins are moved downwardly so that the shaft portions 58 of the pins seat within the narrow, lower portions of the tear-drop shaped holes. FIG. 8 shows the arrangement of the pins 57 on the angle bracket 55 and FIG. 7 illustrates the pins seated within the holes 34. As can be seen, one leg of the angle bracket is preferably larger than the other so that it overlaps the adjacent channel 30 in the post.

Figure 9:
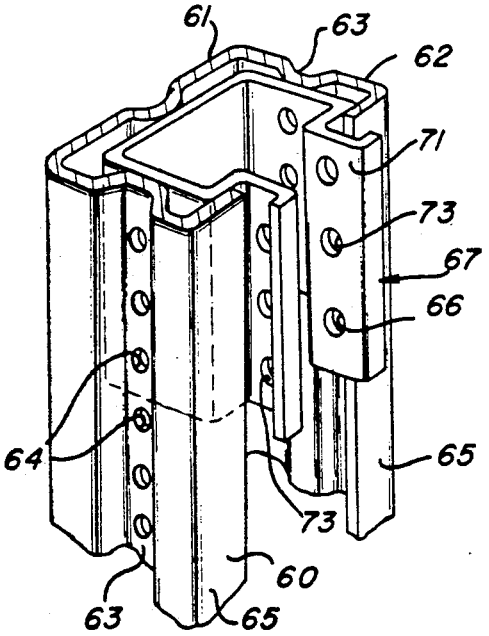
FIG. 9 is a fragmentary, perspective view of a modification having a short connector tube assembled within a conventional post for modifying the post.
Figure 10:
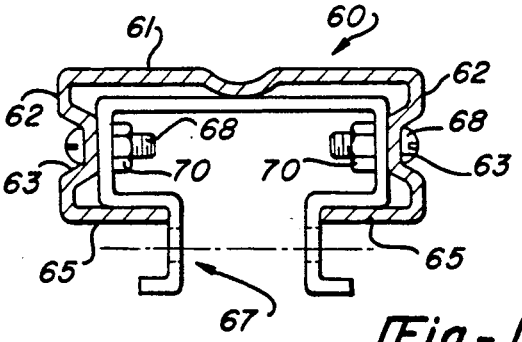
FIG. 10 is a cross-sectional view of the connector of FIG. 9 fastened within a post.
Figure 11:
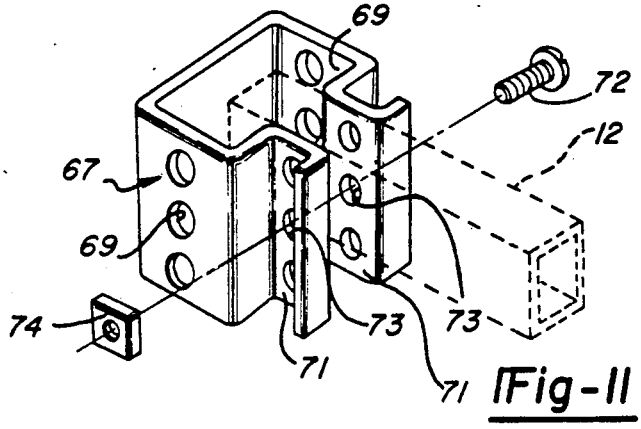
FIG. 11 is a perspective view of the connector of FIG. 9, separated from the post, with a brace, shown in dotted lines, assembled within the connector.

FIGS. 9–11 illustrate a modified post construction. The post 60 is a squared C-shape in cross-section. It is essentially a conventional shaped post, with a rear wall 61, side walls 62 and grooves 63 rolled into the side walls. Holes 64 are formed in the grooves 63. Opposed front wall sections 65 are spaced from each other to provide the C-shape.

A short, connector tube 67 is shaped, in cross-section, similarly to the post 11 described above. However, the connector tube is of a size to snugly fit within the post 60 with its side walls engaging the bases of the groove 63 in the side walls of the post 60.

The short connector tubes are fastened within the elongated post 60 by means of screws 68 extending through holes 64 in the grooves 63 and into aligned holes 69 in the side walls of the connector tube. The bolts threadedly engage with nuts 70 for fastening the connector tube within the post 60 at desired locations along the vertical length of the post. With this construction, braces, such as horizontal brace 12, which is shown in dotted lines, are fastened between forwardly extending base walls 71 of the connector tube by means of screws 72 inserted through aligned holes 73 in the base walls 71 and holes in the brace end portion, and nuts 74 (see FIG. 11).

As many short connector tubes may be used as are necessary to connect the desired number of horizontal and angled braces that are used to interconnect a pair of posts. The connectors may be slid into the required position and then fastened in place.

The foregoing construction permits rapid and easy assembly of the parts forming the rack. Thus, using a minimal amount of labor, the rack parts can be assembled on-site by unskilled workmen. Hence, the parts can be warehoused and shipped to the site of use in knock-down condition. That reduces the cost of warehousing and shipping considerably so that the overall construction, with the labor saving assembly, is less expensive and easier to handle than previously available partially, pre-assembled, racks of this type.

This invention may be further developed within the scope of the following claims. Accordingly, it is desired that the foregoing description be read as being merely illustrative of an operative embodiment of this invention and not in a strictly limited sense.

Having fully described one operative embodiment of this invention, I now claim:

1. A corner post for a heavy duty storage rack formed of vertical corner posts which are interconnected by elongated horizontal and angled members to form a frame for supporting heavy loads, comprising:

a vertical, sheet metal tube bent into a rear wall with integral opposite side walls and with the free edges of the side walls bent into flat wall sections that extend towards each other to form a front wall having a central, vertically extending space located between the sections;

each of said sections having an integral end portion which is bent away from the rear wall to form a pair of spaced apart, parallel base walls which terminate in integral, narrow flanges that are bent outwardly, relative to each other, roughly parallel to their sections, so that the sections and their respective base walls and flanges form oppositely opening channels extending vertically along the length of the post;

a series of spaced apart holes formed in the opposite base walls, with each hole in one base wall being horizontally aligned with a corresponding hole in the opposite base wall, screw-like fasteners received through the aligned pairs of holes;

screw fastening nuts received in said channels, said channels being of a width to closely receive said screw fastening nuts positioned within the channels and through which the screws may be extended for fastening the screws to the posts, so that the screws may be manually turned while the nuts are restrained from turning during the fastening of the screws thereto;

and with the spacing between the horizontal base walls being preselected to closely received end portions of rack horizontal and angled members having opening through which screws that pass through a pair of aligned holes formed in the base walls may be extended for thereby rigidly fastening the member end portions to the post;

whereby a pair of posts may be rapidly interconnected by said elongated members by inserting the end portions of the members between the base walls and inserting screws through aligned holes in the base walls and the member end portion and holding corresponding nuts within one of the channels and rotating the screw head for fastening the screw in place.

2. A construction as defined in claim 1, and including a horizontal support plate upon which the bottom of the post is rested for supporting the post upon a ground-like surface;

said plate being formed in an H-shape with integral metal strips, formed by the metal portions of the plate between the opposite legs of the H-shape, being bent vertically upwardly and being of a width to snugly fit within the opposite channels formed on the post;

and securing the strips to the portions of the channel base walls portions which they overlap.

3. A construction as defined in claim 2, and with an integral, bent up plate flange formed on about the center of one edge of the H-shaped plate and overlapping the post rear wall; and fasteners securing the plate flange to the overlapped portion of said tube rear wall.

4. A construction as defined in claim 1, and including a series of vertically spaced apart holes formed in the post rear wall, one above the other, and shaped for receiving fasteners formed on a bracket that is arranged upon the rear wall and which is connected to a horizontally extending beam, whereby rack support beams may be fastened to the post.

5. A construction as defined in claim 1, and said tube being of a relatively short length and forming an inner tube which is closely fitted within an outer, sheet metal tube which is many times the length of the inner tube; and with the outer tube having a rear wall and integral, bent side walls which correspond to and overlap the corresponding rear wall and side walls of the inner tube, and having bent front wall sections corresponding to and overlapping the front wall sections of the inner tube; and with the inner tube parallel base walls and their bent flanges extending outwardly of the space between the outer tube sections and forming the channels with said outer tube sections.

6. A construction as defined in claim 5, and said outer tube being formed of a conventional, substantially square C-shaped sheet metal post within which a number of said inner tubes are positioned.

7. A corner post for a heavy duty storage rack formed of vertical corner posts which are interconnected by elongated horizontal and angled members to form a frame which supports heavy loads, comprising:

an elongated, vertical, sheet metal post bent into a rear wall and integral opposite side walls, with the free edges of the side walls being bent into front wall sections that extend towards each other, but are spaced apart to form a uniform width, vertically extended space between the sections;

a number of short, bent sheet metal tube sections, each formed with a rear wall, integral side walls and front wall sections corresponding to the post rear wall, side walls and front wall sections, with the tube sections closely fitted within the post, but with each of the tube sections also having the free ends of their wall sections bent into outwardly extending base wall portions that are parallel to each other and which terminate in outwardly bent flange portions so as to form oppositely, outwardly extending channels on the front wall of the post;

a series of holes formed in the base walls, with the holes in one base wall aligned with the holes in the opposite base wall of each of the tube sections;

a series of vertically aligned holes formed in the post for alignment with and for receiving fasteners extending through the post and the short tube sections for connecting them in predetermined places along the vertical height of the posts;

whereby horizontal or angled elongated members may be snugly positioned between the base walls of the short tube sections and secured therein by means of mechanical fasteners.

8. A construction as defined in claim 7, and including said oppositely extending flanges being of a width corresponding to the width of a screw fastener nut for receiving such nuts and holding them against rotation, and with screws extending through aligned holes in the base walls and elongated member end portions arranged between the base walls and threadedly engaged with the nuts so that the screws may be turned while the nuts are held against turning for fastening the elongated members in place.

9. A construction as defined in claim 7, and including a horizontal support plate for supporting the bottom of the post upon a ground-like support surface; said plate being formed in an H-shape with integral, metal strips formed by and bent upwardly between the legs of the H-shape and being of a width to snugly fit within the opposite channels formed on the lowermost short tubular member and fastened therein by means of mechanical fasteners.

10. A construction as defined in claim 9, and including an integral, bent up plate flange formed on the center portion of one edge of the H-shaped plate and overlapping the rear wall of the post, and being fastened to the rear wall of the post by a releasable fastener.

11. A post for a heavy duty, storage rack formed of vertical posts which are interconnected by horizontal or angled elongated members to form a frame upon which heavy loads may be supported, comprising:

a normally vertically arranged, sheet metal tube bent into a rear wall, with integral, opposite side walls and with the free edges of the side walls bent into flat, front wall sections that extend towards each other and are bent outwardly to form parallel base walls, each terminating in an outwardly extending bent flange so that the sections, base walls and flanges each form oppositely opening channels extending along the height of the post on the front wall thereof, fastener nuts received in said channel, the horizontally directed widths of said channels being selected to closely receive said fastener nuts for engaging threaded screws extending through aligned holes formed in the base walls of the channels and the portions of elongated members extended between and snugly held between the base walls so that the screws may be threadedly engaged and tightened while the nuts are held by the channels against rotation;

a series of vertically aligned holes formed in the base walls, with the holes of one wall having an aligned hole in the opposite base wall for receiving screw-like fasteners which may be extended through corresponding openings in an elongated member for securing the member between the base walls;

the rear wall of the post being divided vertically into two, parallel, coplanar vertical sections, each having a series of vertically aligned openings formed therein for receiving fasteners mounted on a bracket carrying a frame beam for thereby connecting a frame beam to the post.

12. A construction as defined in claim 11, and with the holes formed in the rear wall of the post being shaped with wider upper portions and narrower lower portions, as for example, a bayonet slot shape, for removably receiving corresponding pin-type, headed fasteners on a beam mounting bracket.

* * * * *